US007457747B2

(12) United States Patent
Ojanpera

(10) Patent No.: US 7,457,747 B2
(45) Date of Patent: Nov. 25, 2008

(54) NOISE DETECTION FOR AUDIO ENCODING BY MEAN AND VARIANCE ENERGY RATIO

(75) Inventor: Juha Ojanpera, Nokia (FI)

(73) Assignee: Nokia Corporation, Espoo (FI)

( * ) Notice: Subject to any disclaimer, the term of this patent is extended or adjusted under 35 U.S.C. 154(b) by 771 days.

(21) Appl. No.: 10/924,006

(22) Filed: Aug. 23, 2004

(65) Prior Publication Data

US 2006/0041426 A1 Feb. 23, 2006

(51) Int. Cl.
*G10L 21/02* (2006.01)
*G10L 19/00* (2006.01)

(52) U.S. Cl. ..... 704/226; 704/501

(58) Field of Classification Search ..... None
See application file for complete search history.

(56) References Cited

U.S. PATENT DOCUMENTS 5,323,337 A 6/1994 Wilson et al.
5,664,052 A * 9/1997 Nishiguchi et al. ..... 704/214
5,809,455 A 9/1998 Nishiguchi et al.
6,327,564 B1 12/2001 Gelin et al.
6,424,939 B1 * 7/2002 Herre et al. ..... 704/219
6,647,365 B1 11/2003 Faller

FOREIGN PATENT DOCUMENTS

EP 0 945 854 9/1999

OTHER PUBLICATIONS

Overview of MPEG-4 Audio and Its Applications in Mobile Communications, Herre et al., Germany, 2000 IEEE, pp. 604-613.
Advanced Software Implementation of MPEG-4 AAC Audio Encoder, Domazet et al., EC-VIP-MC 2003, 4th EURASIP Conference, Jul. 2-5, 2003, pp. 679-684.
Estimation of Perceptual Entropy Using Masking Criteria, 1988 IEEE, CH2561-9/9/88/0000-2524, James D. Johnson, pp. 2524-2527.
Improving Audio Codecs by Noise Substitution, J. Audio Eng. Soc., vol. 44, No. 7/8, Jul./Aug., Donald Schulz, pp. 593-598, 1996.

* cited by examiner

*Primary Examiner*—David R Hudspeth
*Assistant Examiner*—Brian L Albertalli

(57) ABSTRACT

The techniques described are utilized for detection of noise and noise-like segments in audio coding. The techniques can include performing a prediction gain calculation, an energy compaction calculation, and a mean and variation energy calculation. Signal adaptive noise decisions can be made both in time and frequency dimensions. The techniques can be embodied as part of an AAC (advanced audio coding) encoder to detect noise and noise-like spectral bands. This detected information is transmitted in a bitstream using a signaling method defined for a perceptual noise substitution (PNS) encoding tool of the AAC encoder.

20 Claims, 2 Drawing Sheets

NOISE DETECTION FOR AUDIO ENCODING BY MEAN AND VARIANCE ENERGY RATIO

BACKGROUND OF THE INVENTION

1. Field of the Invention

The present invention relates generally to audio coding techniques. More particularly, the present invention relates to noise detection for audio encoding.

2. Description of the Related Art

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the claims in this application and is not admitted to be prior art by inclusion in this section.

Generally, in an audio encoding system, an incoming time domain audio signal is compressed such that the bitrate needed to represent the signal is significantly reduced. Ideally, the bitrate of the encoded signal fits to the constraints of the transmission channel or minimizes the size of the encoded file. Techniques for fitting bitrate to channel constraints are used in real-time communication and streaming services. Techniques for minimizing file size are used when storing audio content locally or via downloading at high audio quality.

Audio encoders aim to minimize perceptual distortion at a given bitrate while minimizing the encoded file size. Nevertheless, the lower the bitrate, the more challenging it is for the encoder to achieve these goals. In both cases, advanced encoding models and techniques are applied to maximize the end user experience. Typically, it is the encoding performance with the worst-case signals (signals that are difficult to encode) that ultimately defines the overall performance of any encoding system. Another important factor in defining overall performance of an encoding system is the encoding speed and the resources needed for a given bitrate or audio quality level that can be achieved. For commercial use and especially for mobile use, encoding speed and memory requirements play a significant role.

In an attempt to achieve even lower bitrates without reducing the perceptual distortion, new audio coding methods are being explored. Some conventional audio coding methods involve efficient coding of noise and noise-like signal segments. In such techniques, perceptual audio encoders encode the input signal in frequency domain, as human auditory properties can be best described in frequency domain. Spectral samples are typically quantized on a frequency band basis. The quantizer shapes the quantization noise by either increasing or decreasing the corresponding quantizer step size until the noise is just below the auditory masking threshold. On one hand, the introduced perceptual distortion is inaudible to the human ear but, on the other hand, this limits the lowest possible bitrate. It is well known that coding of high frequencies uses significant numbers of bits, but from perceptual point of view, it is the low frequencies that are more important.

Where a certain frequency band contains only white noise, the spectral samples within the band are still coded (with high bitrate) even though from an auditory point of view an exact representation of the spectral samples is not needed. It would be much more efficient to code the frequency band with a coding scheme optimized for noise or noise-like signal segments leaving more bits to the other frequency bands or, alternatively, lowering the lowest possible bitrate boundary.

One example of an audio coding system is the advanced audio coding (AAC) system. The AAC is a lossy data compression scheme intended for audio streams. AAC was designed to replace MP3 and is an extension of the MPEG-2 international standard, ISO/IEC 13818-3. It was further improved in MPEG-4, MPEG-4 Version 2 and MPEG-4 Version 3, ISO/IEC 14496-3.

AAC includes signaling methods for compact representation of noise and noise-like signal segments. However, AAC does not have a way to detect such signal segments. It is up to the implementer of the AAC encoder to decide how noise or noise-like signal segments should be detected or whether to detect such segments at all. Uncontrolled and false noise detection can actually result in severe quality degradation instead of quality improvement.

Attempts have been made to estimate and detect noise for perceptual audio coders, such as AAC coders. For example, a method using a predictor in the frequency domain on a frequency band basis is presented in: "Estimation of perceptual entropy using noise masking criteria," Johnston, J. D.; Acoustics, Speech, and Signal Processing, 1988. ICASSP-88., 1988 International Conference on, 11-14 Apr. 1988; Pages: 2524-2527 vol. 5. Johnston describes calculating a tonality measure from the power spectrum, which is then used as a threshold to differentiate noise-like and tone-like signal segments. A method to use a predictor in time domain and noise detection in frequency domain is described in "Improving audio codecs by noise substitution, Schulz Donald; Journal of the Audio Engineering Society," Vol. 44, No. 7/8, July/August 1996; Pages: 593-598. In this method, a predicted version of the input signal is first determined and noise detection is then made in frequency domain by comparing the original and predicted signals on a frequency band basis.

There is a need for noise detection techniques to be applied in various types of audio coding schemes. Further, there is a need for efficient estimation methods for detecting noise and noise-like signal segments. Even further, there is a need to reduce the bitrate of AAC encoded streams, which reduces the demand for bandwidth.

SUMMARY OF THE INVENTION

Briefly, the present invention relates to techniques for detection of noise and noise-like segments in audio coding. While AAC coding is used as an example, the present invention is applicable in other types of coding, which utilize specific coding methods for noise and noise-like segments or need a reliable method to detect these segments for a reason or another.

One exemplary embodiment relates to a method of estimating and detecting noise and noise-like spectral signal segments. The method includes performing a prediction gain calculation, an energy compaction calculation, and a mean and variation energy calculation. Signal adaptive noise decisions are made both in time and frequency dimensions. The method can be embodied as part of an AAC encoder to detect noise and noise-like spectral bands. This detected information is transmitted in a bitstream using a signaling method defined for a perceptual noise substitution (PNS) encoding tool of the AAC encoder.

Another exemplary embodiment relates to a system for estimating and detecting noise and noise-like spectral signal segments. The system includes an electronic device having a processor and an encoder that determines noise or noise-like characteristics in frequency bands of the received communication signals using defined boundaries for a ratio of mean and variance energies in each frequency band. The system may also include a communication interface, that sends and receives communication signals.

Another exemplary embodiment relates to a device configured for estimating and detecting noise and noise-like spectral signal segments. The device includes a memory configured to contain programmed instructions and communication signals and an encoder that determines noise or noise-like characteristics in frequency bands of the communication signals using defined boundaries for a ratio of mean and variance energies in each frequency band. The device may also be configured for communication in a network.

Another exemplary embodiment relates to a computer program product that estimates and detects noise and noise-like spectral signal segments. The computer program product includes computer code to calculate mean and variance energies for each frequency band of a signal, computer code to define boundaries for a ratio of the mean and variance energies in each frequency band of the signal, and computer code to determine if each frequency band of the signal is noise or noise-like using the defined boundaries.

DETAILED DESCRIPTION OF EXEMPLARY EMBODIMENTS

Figure 1:
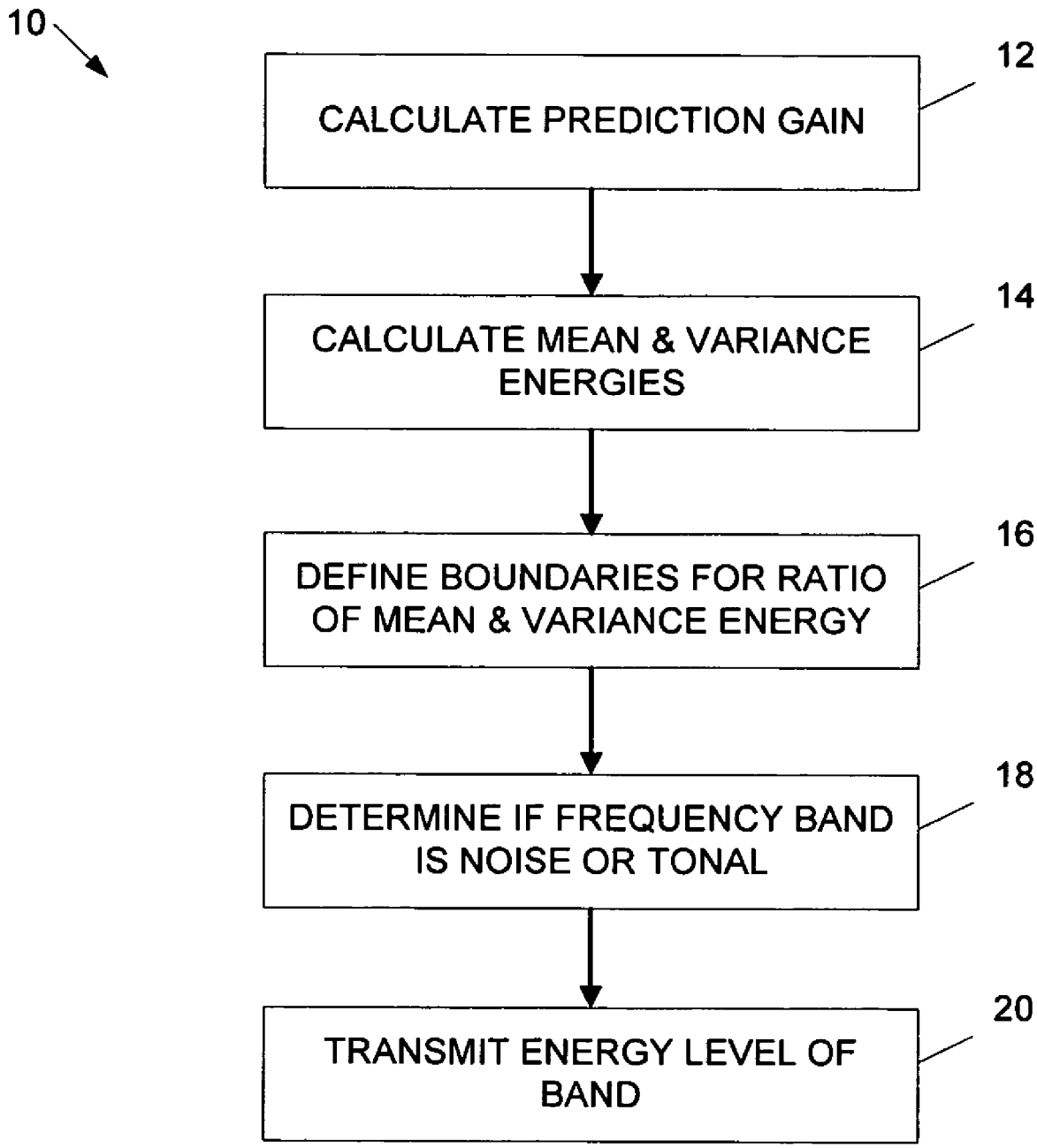
FIG. 1 is a flow diagram depicting operations performed in the estimation and detection of noise and noise-like spectral signal segments in audio coding in accordance with an exemplary embodiment.

FIG. 1 illustrates a flow diagram 10 depicting operations performed in the estimation and detection of noise and noise-like spectral signal segments in audio coding. Additional, fewer, or different operations may be performed depending on the embodiment. In an operation 12, a gain prediction for the spectral samples corresponding to each frequency band is calculated. In this calculation, the variable x represents a frequency domain signal of length N: $x=F(x_t)$ where $x_t$ is the time domain input signal and F( ) denotes time-to-frequency transformation. The variable sfbOffset of length M represents the boundaries of the frequency bands, which follow also the boundaries of the critical bands of human auditory system.

A gain prediction is calculated for each frequency band. In an exemplary embodiment, the prediction gain is determined by applying linear predictive coding (LPC) principles to spectral samples within each frequency band and accumulating the resulted gain across the frequency bands to obtain an average prediction gain aGain for the current frame as:

$$aGain = \frac{1}{M} \cdot \sum_{i=0}^{M-1} sbGain(i)$$

$$sbGain(i) = \begin{cases} fGain_i, & fGain_i < gThr \\ gThr, & \text{otherwise} \end{cases}$$

where $fGain_i$ is the prediction gain of the $i^{th}$ frequency band and gThr is the global threshold for the prediction gain. This threshold prevents the average prediction gain from being too high in case some of the spectral bands have significant prediction gain. In an example implementation, the value of gThr is set to 1.45.

The prediction gain for the $i^{th}$ frequency band can be obtained by solving the normal equations:

$$\sum_{k=1}^{P} a_k \cdot R_i(n-k) = R_i(n),\ 1 \le n \le P$$

where P defines the order of the filter coefficients $a_k$ and R is the autocorrelation sequence of the spectral samples calculated by:

$$R_i(n) = \sum_{k=1}^{sfbLen-1} x(sfbOffset(i)+k) \cdot x(sfbOffset(i)+k-n)$$

where sfbLen=sfbOffset(i+1)−sfbOffset(i) is the length of the $i^{th}$ frequency band.

The predictor order P can be determined based on the length of the frequency band:

$$P=\min(10, sfbLen/4)$$

One solution of the normal equations is performed by the Levinson-Durbin recursion. The following operations can be performed for m=1, . . . , P, where $a_k^{(m)}$ denotes the $k^{th}$ coefficient of an $m^{th}$ order predictor by:

$$akk_m = \frac{R_i(m) - \sum_{k=1}^{m-1} a_k^{(m-1)} \cdot R_i(m-k)}{E_{m-1}^i}$$

$$a_m^{(m)} = akk_m$$

$$a_k^{(m)} = a_k^{(m-1)} - akk_m \cdot a_{m-k}^{(m-1)},\ 1 \le k \le m-1$$

$$E_m^i = (1 - akk_m^2) \cdot E_{m-1}^i \text{ where}$$

$$E_0^i = R_i(0).$$

The prediction gain can be obtained by:

$$fGain_i = \frac{R_i(0)}{E_P^i}$$

Next, mean and variance energies can be calculated for each frequency band by:

$$eMean_i = \frac{1}{sfbLen} \cdot \sum_{k=0}^{sfbLen-1} x(sfbOffset(i)+k)^2$$

$$eVar_i = \frac{1}{sfbLen} \cdot \sum_{k=0}^{sfbLen-1} |eMean_i - x(sfbOffset(i)+k)^2|$$

The mean and variance energies are used to define the boundaries for the ratio of the mean and variance energy and how much that ratio is allowed to vary in each frequency band. This range can be used to differentiate whether the frequency band is noise-like or tonal-like. The allowed range can be obtained by:

$$eRatio = \frac{1}{M} \cdot \sum_{i=0}^{M-1} \frac{eMean_i}{eVar_i}$$

$$vMax = \begin{cases} eRatio, & eRatio \geq 1.0 \\ 1.0/eRatio, & \text{otherwise} \end{cases}$$

$$acc = \begin{cases} 2.6 \cdot aGain, & 2.6 \cdot aGain > vThr \\ vThr, & \text{otherwise} \end{cases}$$

$$eMeanMax = vMax^{acc}$$

$$eMeanMin = 1.0/eMeanMax$$

where vThr defines the threshold for the mean energy range calculation. In the an example implementation, this value is set to 3.3, but also other values may be applied.

A stage of decisions can be made for each frequency band to see whether the band is noise/noise-like or tonal/tonal-like as follows $$isNoise_i^1 = \begin{cases} 1, & fGain_i < w_i^1 \cdot aGain \cdot pGain_i \\ 0, & \text{otherwise} \end{cases}$$

where $pGain_i$ is the adjusted prediction gain of previous frame for the $i^{th}$ frequency band and $w_i^1$ is the frequency band dependent weighting factor, which is updated according to:

$$w_i^1 = \sqrt{w_{i-1}^1}$$

where $w_{-1}^1 = 0.7$ in an example implementation. Also, $$isNoise_i^2 = \begin{cases} 1, & isNoise_i^1 == 1 \text{ and } eComp_i < w_i^2 \cdot cThr \\ 0, & \text{otherwise} \end{cases}$$

where $eComp_i$ defines the energy compression ratio of the $i^{th}$ frequency band, $w_i^2$ is frequency band dependent weighting factor, and cThr is global threshold value for the energy compression ratio. In the current implementation the value of cThr is set to $10^{-0.1}$. The energy compression ratio can be calculated according to:

$$y_i(n) = e(n) \cdot \sum_{k=0}^{sfbLen-1} x(sfbOffset(i) + k) \cdot \frac{\cos((2 \cdot k + 1) \cdot n \cdot \pi)}{2 \cdot sfbLen},$$

$$0 \leq n \leq sfbLen - 1$$

$$e(n) = \begin{cases} \sqrt{2}^{-1}, & n == 0 \\ 1, & \text{otherwise} \end{cases}$$

$$eComp_i = \frac{\sum_{k=0}^{sfbLen/2-1} y_i(k)^2}{\sum_{k=sfbLen/2}^{sfbLen-1} y_i(k)^2}$$

The frequency dependent weighting factor $w_i^2$ can be updated according to:

$$w_i^2 = \sqrt{w_{i-1}^2}$$

where $w_{-1}^2 = 0.7$ in an example implementation. The noise decision stage is:

$$isNoise_i^3 = \begin{cases} 1, & \begin{pmatrix} isNoise_i^2 == 1 \text{ and} \\ \begin{pmatrix} eMVRatio_i > eMeanMax \\ \text{or} \\ eMVRatio_i < eMeanMin \end{pmatrix} \end{pmatrix} \\ 0, & \text{otherwise} \end{cases}$$

$$eMVRatio_i = \frac{eMean_i}{eVar_i}$$

If the $i^{th}$ frequency band was assigned to be noise or noise-like, i.e., $isNoise_i^3 = 1$, then what is transmitted to the receiver is the energy level of the band. The same signaling method used in an AAC codec can be used here. The prediction gain related to the time dimension of each frequency band is finally updated as:

$$pGain_i = \begin{cases} 0.25 \cdot pGain_i + 0.75 \cdot fGain_i, & pGain_i \text{ != } 1.0 \text{ and } isNoise_i^3 == 1 \\ fGain_i, & pGain_i == 1.0 \text{ and } isNoise_i^3 == 1 \\ 1.0, & \text{otherwise} \end{cases}$$

Equation (13) may be realized with fast algorithms that use transform length of $2^n$. In case the length of the frequency band does not fit into these conditions, that is, the length is smaller than the length of the transform, zero padding can be used. Also, it is known that human auditory system is more sensitive at low frequencies than at high frequencies. Therefore, for optimal performance, it is advantageous to limit the lowest possible noise frequency band to some threshold frequency, such as 5 kHz, but also other values are applicable.

In an implementation using an AAC encoder, the following parameters can be used. The time-to-frequency transformation F( ) is 128- or 1024-point MDCT, the sfbOffset table depends on the sampling rate and are listed in the AAC specifications but, for example, at 44 kHz the table for 128- and 1024-point MDCTs are as:

M=49;

sfbOffset_1024[]={0, 4, 8, 12, 16, 20, 24, 28, 32, 36, 40, 48, 56, 64, 72, 80, 88, 96, 108, 120, 132, 144, 160, 176, 196, 216, 240, 264, 292, 320, 352, 384, 416, 448, 480, 512, 544, 576, 608, 640, 672, 704, 736, 768, 800, 832, 864, 896, 928, 1024};

M=14;

sfbOffset_128[]={0, 4, 8, 12, 16, 20, 28, 36, 44, 56, 68, 80, 96, 112, 128};

If the start of noise detection band is limited to 5 kHz, the tables are as:

M=22;

sfbOffset_1024[]={264, 292, 320, 352, 384, 416, 448, 480, 512, 544, 576, 608, 640, 672, 704, 736, 768, 800, 832, 864, 896, 928, 1024};

M=6;

sfbOffset_128[]={44, 56, 68, 80, 96, 112, 128};

It is also possible to define the start of noise detection band to be below 5 kHz. In this case it is advantageous to make the noise detection calculations separately; one set of calculations for the frequency bands below 5 kHz and the other set of calculations for frequency bands above 5 kHz. Also the thresholds related to prediction gain and mean energy threshold calculations can be adjusted to better cope with the sensitivity of human auditory system at low frequencies; values 1.15 and 4.0, respectively, provide best performance for the frequencies below 5 kHz.

The techniques described require no buffering of previous frame samples, which is one of the main drawbacks of prior solutions. Buffering typically extends to at least 2-3 past frames and with larger frame sizes this requires a lot of static RAM storage during encoding. The noise estimation is done using signal adaptive threshold values and no hard threshold levels are used which is typically used in prediction based noise estimation solutions. Furthermore, the complexity of the method plays no significant role in the whole encoder implementation as only few calculations are done for each frame and additional calculations are done only to those frequency bands which have high probability to be noise or noise-like. For example, the number of noise or noise-like frequency bands with respect to total number of frequency bands present can be less than half or more.

Simulations using the described techniques have shown that reliable noise detection can be achieved without introducing any perceptual distortions to the coded signals. The bitrate limit for the lowest possible bitrate depends on the signal content but, with typical signals, bitrate reduction between 5-15% can be expected when compared to an encoding where noise detection and substitution is not applied.

Figure 2:
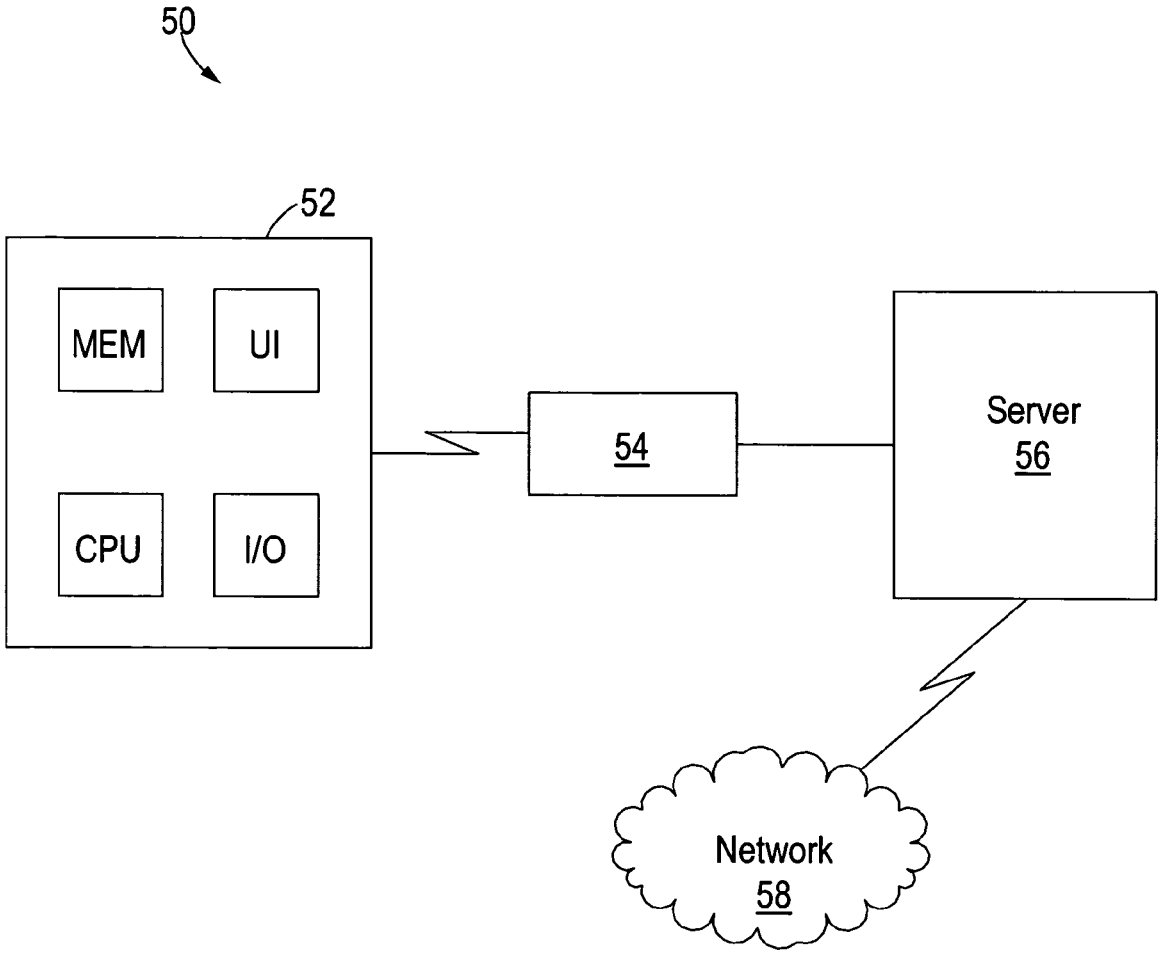
FIG. 2 is a diagram depicting an exemplary communication system including the techniques discussed with reference to FIG. 1.

FIG. 2 illustrates a system 50 including the noise detection feature described herein. The exemplary embodiments described herein can be applied to any system capable coding of signals. An exemplary system 50 includes a terminal equipment (TE) device 52, an access point (AP) 54, a server 56, and a network 58. The TE device 52 can include memory (MEM), a central processing unit (CPU), a user interface (UI), and an input-output interface (I/O). The memory can include non-volatile memory for storing applications that control the CPU and random access memory for data processing. The I/O interface may include a network interface card of a wireless local area network, such as one of the cards based on the IEEE 802.11 standards.

The TE device 52 may be connected to the network 58 (e.g., a local area network (LAN), the Internet, a phone network) via the access point 54 and further to the server 56. The TE device 52 may also communicate directly with the server 56, for instance using a cable, infrared, or a data transmission at radio frequencies. The server 56 may provide various processing functions for the TE device 52.

The TE device 52 can be any electronic device, for example a personal digital assistant (PDA) device, remote controller or a combination of an earpiece and a microphone. The TE device 52 can be a supplementary device used by a computer or a mobile station, in which case the data transmission to the server 56 can be arranged via a computer or a mobile station. The TE device 52 can be a personal computer (PC) or other computing device in which, for example, music is encoded and sent over an air channel to a mobile device or over the Internet to another PC. In an exemplary embodiment, the TE device 52 is a mobile station communicating with a public land mobile network, to which also the server 56 is functionally connected. The TE device 52 connected to the network 58 includes mobile station functionality for communicating with the network 58 wirelessly. The network 18 can be any known wireless or wired network, for instance a network supporting the GSM service, a network supporting the GPRS (General Packet Radio Service), or a third generation mobile network, such the UMTS (Universal Mobile Telecommunications System) network according to the 3GPP (3$^{rd}$ Generation Partnership Project) standard. The functionality of the server 56 can also be implemented in the mobile network. The TE device 56 can be a mobile phone used for speaking only, or it can also contain PDA (Personal Digital Assistant) functionality.

While several embodiments of the invention have been described, it is to be understood that modifications and changes will occur to those skilled in the art to which the invention pertains. The invention is not limited to a particular embodiment, but extends to various modifications, combinations, and permutations that nevertheless fall within the scope and spirit of the appended claims.

I claim:

1. A method for estimating and detecting noise and noise-like spectral signal segments, the signal segments corresponding to one or more frequency bands of a signal, the method comprising:

calculating mean and variance energies for each frequency band of a signal;

defining boundaries for a ratio of the mean and variance energies in each frequency band of the signal; and determining if each frequency band of the signal is noise or noise-like using the defined boundaries and a stage of two or more decisions.

2. The method of claim 1, further comprising predicting gain for spectral samples corresponding to each frequency band of a signal.

3. The method of claim 2, wherein predicting gain for spectral samples corresponding to each frequency band of a signal comprises applying linear predictive coding principles and accumulating resulting gain.

4. The method of claim 1, further comprising transmitting energy levels for each frequency band.

5. The method of claim 4, wherein the energy levels are transmitted using a signal defined for a perceptual noise substitution encoding tool of an encoder.

6. The method of claim 1, further comprising providing signal-adaptive noise decisions in time and frequency dimensions.

7. The method of claim 1, further comprising determining if each frequency band is tonal or tonal-like using the defined boundaries.

8. A system for estimating and detecting noise and noise-like spectral signal segments, the system comprising:

a device having a processor and an interface that receives signals; and an encoder that determines noise or noise-like characteristics in frequency bands of the received signals using boundaries defined from a ratio of mean and variance energies in each frequency band and a stage of two or more decisions.

9. The system of claim 8, wherein the encoder is an advanced audio coding (AAC) encoder.

10. The system of claim 8, wherein the defined boundaries may change over time.

11. The system of claim 8, wherein the encoder determines if each frequency band is tonal or tonal-like using the defined boundaries.

12. A device configured for estimating and detecting noise and noise-like spectral signal segments, the device comprising:

a memory configured to contain programmed instructions and communication signals; and an encoder that determines noise or noise-like characteristics in frequency bands of the communication signals using boundaries defined from a ratio of mean and variance energies in each frequency band and a stage of two or more decisions.

13. The device of claim 12, wherein the encoder predicts gain for spectral segments for each frequency band.

14. The device of claim 13, wherein the encoder predicts gain using linear predictive coding.

15. The device of claim 12, further comprising an interface capable to transmit energy levels for each frequency band.

16. A computer program product embodied on a computer-readable medium that estimates and detects noise and noise-like spectral signal segments, the signal segments corresponding to one or more frequency bands of a signal, the computer program product comprising:

computer code to calculate mean and variance energies for each frequency band of a signal;

computer code to define boundaries for a ratio of the mean and variance energies in each frequency band of the signal; and computer code to determine if each frequency band of the signal is noise or noise-like using the defined boundaries and a stage of two or more decisions.

17. The computer program product of claim 16, further comprising computer code to determine if each frequency band is tonal or tonal-like using the defined boundaries.

18. The computer program product of claim 16, further comprising computer code to predict gain for spectral samples corresponding to each frequency band of a signal.

19. The computer program product of claim 16, further comprising computer code to transmit energy levels for each frequency band.

20. The computer program product of claim 19, wherein the energy levels are transmitted using a signal defined for a perceptual noise substitution encoding tool of an encoder.

* * * * *